US010041359B2

(12) United States Patent
Brandl et al.

(10) Patent No.: US 10,041,359 B2
(45) Date of Patent: Aug. 7, 2018

(54) DAMPING INLAY FOR TURBINE BLADES

(71) Applicant: Ansaldo Energia Switzerland AG, Baden (CH)

(72) Inventors: Herbert Brandl, Waldshut-Tiengen (DE); Arrigo Beretta-Müller, Ehrendingen (CH)

(73) Assignee: ANSALDO ENERGIA SWITZERLAND AG, Baden (CH)

( * ) Notice: Subject to any disclaimer, the term of this patent is extended or adjusted under 35 U.S.C. 154(b) by 195 days.

(21) Appl. No.: 14/932,313

(22) Filed: Nov. 4, 2015

(65) Prior Publication Data

US 2016/0130953 A1 May 12, 2016

(30) Foreign Application Priority Data

Nov. 10, 2014 (EP) ..... 14192520

(51) Int. Cl.
*F01D 5/26* (2006.01)
*F01D 5/16* (2006.01)
(Continued)

(52) U.S. Cl.
CPC ..... *F01D 5/26* (2013.01); *F01D 5/147* (2013.01); *F01D 5/16* (2013.01); *F01D 5/186* (2013.01);
(Continued)

(58) Field of Classification Search
CPC . F10D 5/26; F10D 5/186; F10D 5/147; F10D 5/16; F10D 5/10; F10D 5/14;
(Continued)

(56) References Cited

U.S. PATENT DOCUMENTS 5,498,137 A 3/1996 El-Aini et al.
6,224,341 B1 5/2001 Fricke
6,258,467 B1 * 7/2001 Subramanian ..... C04B 35/486 416/241 B
(Continued)

FOREIGN PATENT DOCUMENTS

EP 1 892 377 A1 2/2008
WO WO 2015/027064 A1 2/2015

OTHER PUBLICATIONS

Search Report dated Apr. 7, 2015, by the European Patent Office for Application No. 14192520.6.

*Primary Examiner* — Logan Kraft
*Assistant Examiner* — Danielle M Christensen
(74) *Attorney, Agent, or Firm* — Buchanan Ingersoll & Rooney, PC

(57) ABSTRACT

The invention concerns a turbine blade comprising a surface, a recess within the surface, and a damping inlay within the recess. The damping inlay comprises a chamber with a damping material, for example particles. The damping inlay should substantially maintain the aerodynamic profile of the blade to enable normal operation. A further embodiment of the invention describes the method of manufacture of a turbine blade with a damping inlay. The method comprises the steps of manufacturing a turbine blade having a surface and a recess in the surface, and providing one or more damping inlays within the recess such that the damping inlay substantially maintains the aerodynamic profile of the blade, the damping inlay comprising a chamber and a damping material disposed within the chamber.

18 Claims, 3 Drawing Sheets

(51) Int. Cl.
*F01D 5/14* (2006.01)
*F01D 5/18* (2006.01)

(52) U.S. Cl.
CPC ..... *F05D 2220/30* (2013.01); *F05D 2230/10* (2013.01); *F05D 2230/21* (2013.01); *F05D 2230/232* (2013.01); *F05D 2230/237* (2013.01); *F05D 2230/238* (2013.01); *F05D 2230/25* (2013.01); *F05D 2230/30* (2013.01); *F05D 2230/60* (2013.01); *F05D 2240/30* (2013.01); *F05D 2260/96* (2013.01)

(58) Field of Classification Search
CPC . F01D 5/26; F01D 5/186; F01D 5/147; F01D 5/16; F01D 5/10; F01D 5/14; F05D 2240/30
See application file for complete search history.

(56) References Cited

U.S. PATENT DOCUMENTS 6,827,551 B1 * 12/2004 Duffy ..... F01D 5/16 415/119
2006/0277754 A1 * 12/2006 Rockstroh ..... B23P 15/02 29/889.721
2008/0253898 A1 * 10/2008 Bauer ..... F01D 5/16 416/232
2010/0104419 A1 * 4/2010 Liang ..... F01D 5/188 415/115
2013/0108470 A1 * 5/2013 Weisse ..... F01D 5/147 416/97 R
2013/0342360 A1 * 12/2013 Bevly, III ..... H04B 5/0075 340/870.07
2015/0052898 A1 2/2015 Erno et al.

* cited by examiner 11
12
14
20
30
32
34
36
38
40
42
50
52
60
62
64
70
72
80
82

DAMPING INLAY FOR TURBINE BLADES

TECHNICAL FIELD

This invention relates to damping in turbine blades, and more specifically to inserting damping inlays within the surface or outer wall of turbine blades.

BACKGROUND OF THE INVENTION

In turbines, the last stage turbine blade length (aspect ratio) has a significant impact on engine performance. With a longer blade, the speed of the gas stream can be reduced, decreasing flow losses and leading to increased engine efficiency. However, longer high aspect ratio blades suffer vibration problems (e.g. flutter), requiring the addition of means to reduce vibration induced stresses, such as shrouds or snubbers. Such means come with drawbacks such as increased weight or reduced aerodynamic performance. Commonly used under-platform dampers provide insufficient damping for very long blades and can be used only for the vibration modes with insignificant relative movement between neighbouring blades at the platforms. Other means proposed to increase damping include impact dampers (U.S. Pat. No. 6,827,551) and particle dampers (U.S. Pat. No. 6,224,341), whereby a mass or a number of particles are inserted within a cavity in the centre of the blade.

Although impact dampers and particle dampers do provide damping, they also come with several significant problems and limitations. Firstly, considerable design adaptation is required to allow inclusion of these damping means, as cavities must be created within the blade and filled with an appropriate mass or particles. Casting a blade with appropriate cavities may well not be possible, and amending or retrofitting these designs on existing blades is difficult or impossible. In addition, the required cavities may impede the provision of cooling air through blades.

It has therefore been appreciated that it would be desirable to improve the manufacturing process and blade damping design to reduce these problems and limitations.

SUMMARY OF THE INVENTION

The invention is defined in the appended independent claims to which reference should now be made. Advantageous features of the invention are set forth in the dependent claims.

According to a first aspect of the invention, there is provided a turbine blade comprising a surface, a recess within the surface, and a damping inlay within the recess, wherein the damping inlay comprises a chamber and a damping material disposed within the chamber, and the damping inlay substantially maintains the aerodynamic profile of the blade. This allows use of longer last stage turbine blades, and more generally allows use of turbine blades in conditions which would previously have caused too much vibration. It can also provide flexibility of manufacture. This can lead to lighter turbine blades, as the damping inlay can be more efficient as its position on the blade can be optimised, therefore allowing use of a lighter damper. In a preferred embodiment of the invention, the turbine blade additionally comprises cooling means. Compared to existing solutions, the invention allows for relatively unimpeded provision of cooling means due to the flexibility of the design; for example, it could leave any hollow areas within the turbine blade free for cooling air flows.

In a further preferred embodiment of the invention, at least part of the cooling means is provided upstream of at least one damping inlay. This allows for provision of a cooling flow directly over the damping inlay.

In a further preferred embodiment of the invention, the damping material comprises one or more of a mass damper, a mass, a wire mesh, a powder, particles, or a liquid.

A further preferred embodiment provides a plurality of damping inlays are provided for reduction of a plurality of damping modes. The flexibility of this design allows for easy provision of multiple damping inlays in different places around the turbine blade. In this way, optimal damping of multiple vibration modes can be achieved.

A further preferred embodiment provides a gas turbine comprising at least one turbine blade according to the first aspect of the invention. Another preferred embodiment provides a damping inlay according to the first aspect of the invention, wherein the damping inlay additionally comprises a heat protective layer.

According to a second aspect of the invention, there is provided a method of making a turbine blade comprising the steps of manufacturing a turbine blade, the turbine blade having a surface and a recess in the surface, and providing a damping inlay within the recess such that the damping inlay substantially maintains the aerodynamic profile of the blade, the damping inlay comprising a chamber and a damping material disposed within the chamber. This method can simplify blade manufacture and can allow for considerable flexibility and freedom of choice in terms of the position of the damping means on the blade, which allows for positioning of the damping inlay in an effective position, with the result that greater efficiency is possible and therefore, amongst other things, minimisation of the weight of the damping inlay and therefore also the weight of the turbine blade. It also allows use of a variety of different damping materials. In addition, it allows for retrofitting of damping inlays on existing blades.

In a preferred embodiment, the step of manufacturing a turbine blade comprises the steps of manufacturing a turbine blade and removing a portion of a surface of the turbine blade to create a recess in the surface. In a further preferred embodiment, the portion of the surface of the turbine blade is removed using eroding, grinding or milling.

In a preferred embodiment, providing the damping inlay comprises manufacturing a damping inlay and attaching the damping inlay within the recess. This allows for separate manufacture of blades and damping inlays. In a further preferred embodiment, the damping inlay is attached to the turbine blade using welding, brazing, soldering, an additive manufacturing method, selective laser melting, glue or other adhesive means.

In a preferred embodiment, providing a damping inlay comprises at least partially filling the recess with a damping material and covering the recess to complete the damping inlay. In a further preferred embodiment, the damping inlay is manufactured, at least in part, by an additive manufacturing method such as selective laser melting, welding, forging or casting.

BRIEF DESCRIPTION OF THE DRAWINGS

An embodiment of the invention will now be described by way of example only and with reference to the accompanying drawings in which.

DETAILED DESCRIPTION OF THE PREFERRED EMBODIMENTS

Figures 1, 2, 2B:
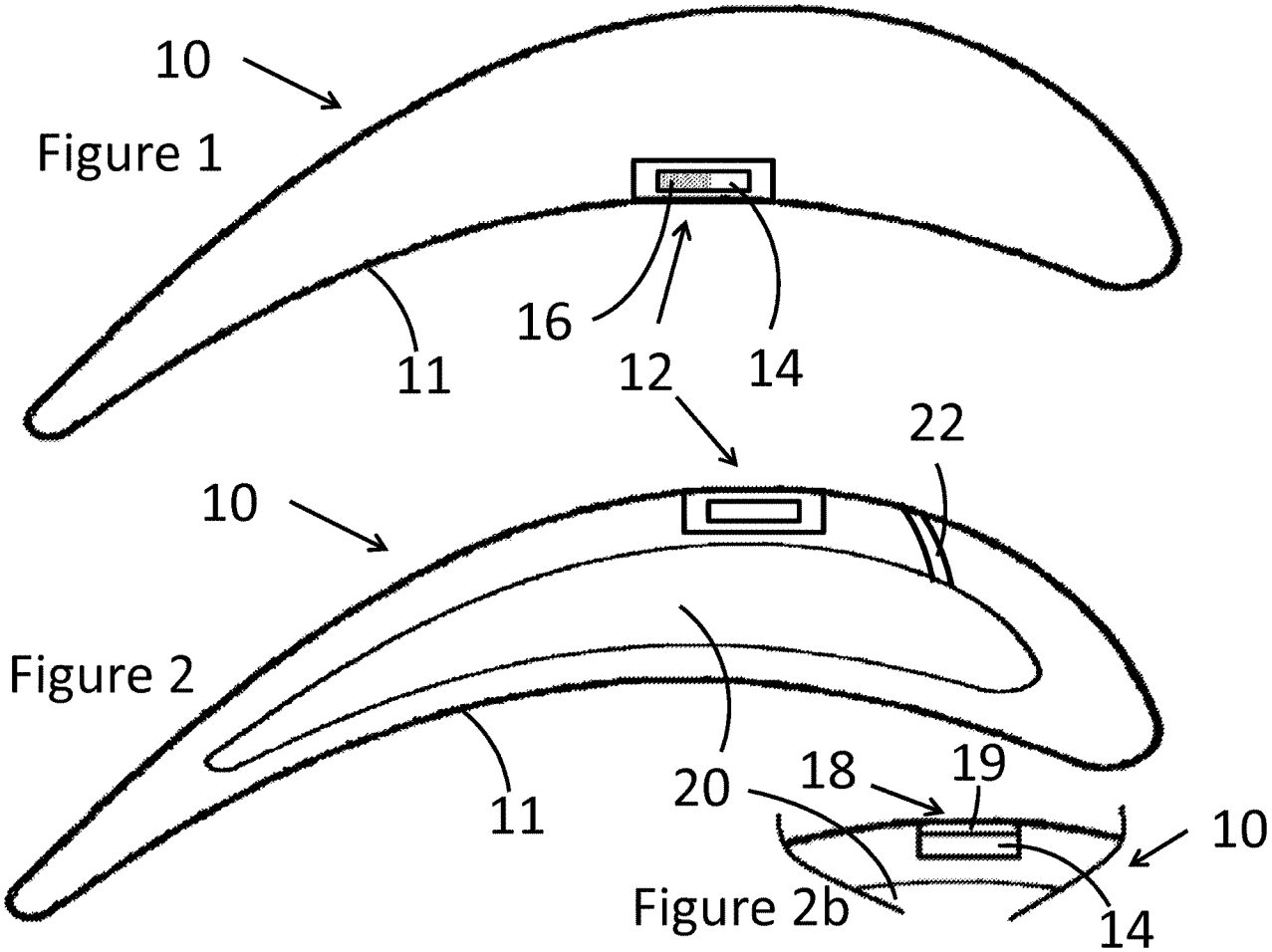
FIG. 1 shows a cross-section view of a turbine blade according to a preferred embodiment of the invention.
FIG. 2 shows a cross-section view of a turbine blade with air cooling according to an embodiment of the invention.
FIG. 2*b* shows a cross-section view of part of a turbine blade as in FIG. 2 according to another embodiment of the invention.

FIG. 1 shows a turbine blade 10, the turbine blade 10 comprising a surface 11, a recess (or cavity) within the surface and a damping inlay or insert 12 within the recess. The damping inlay comprises a chamber 14 with a damping material 16, in this case made of particles. The damping inlay should substantially maintain the aerodynamic profile of the blade to enable normal operation.

Figures 3, 4:
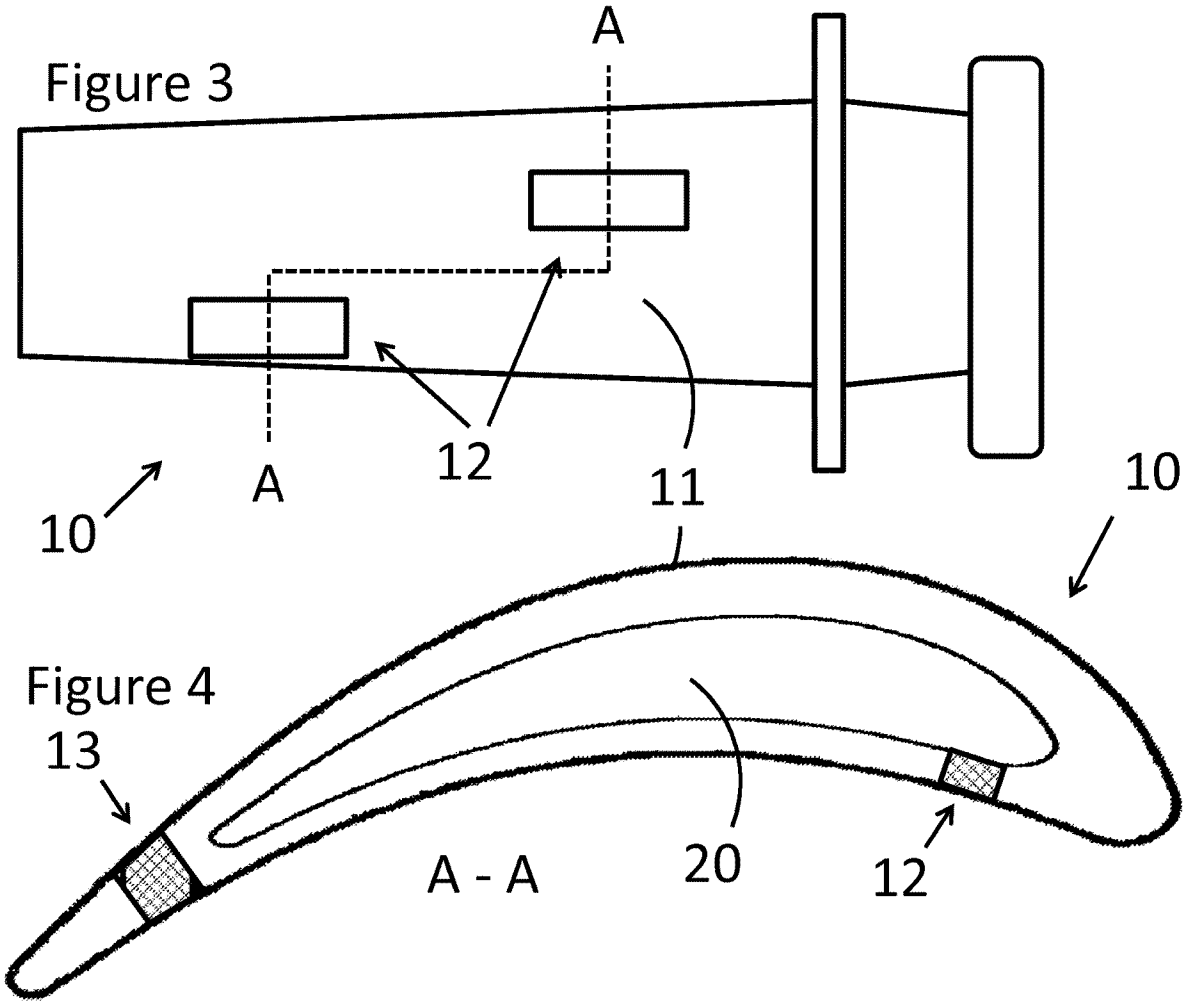
FIG. 3 shows a view of a turbine blade with multiple damping inlays according to an embodiment of the invention.
FIG. 4 shows a cross-section view along line A-A of FIG. 3.
Figures 5, 6A, 6B, 6C, 6D:
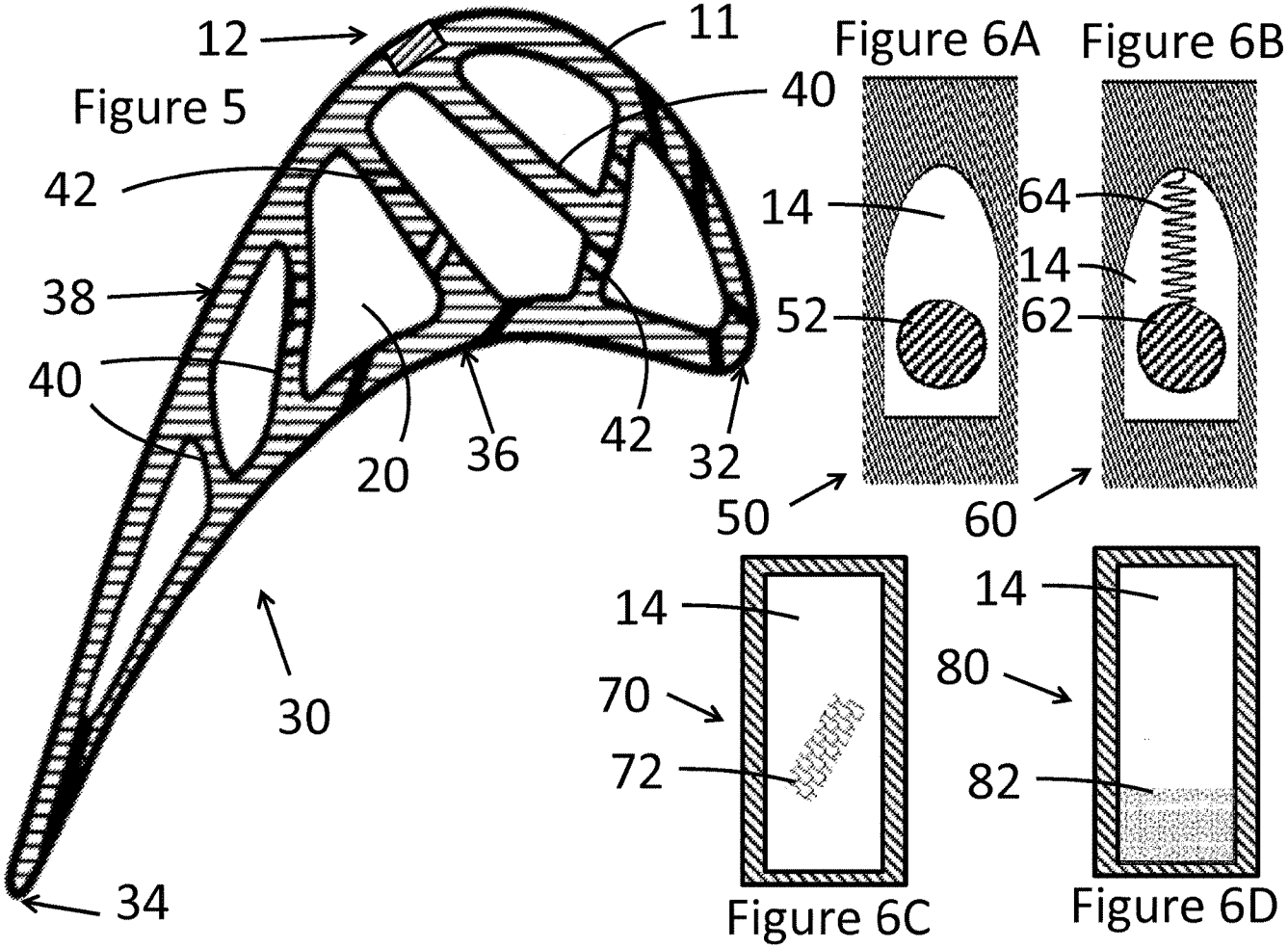
FIG. 5 shows a cross-section view of a hollow turbine blade according to a further embodiment, comprising a web within the turbine blade.
FIGS. 6A to 6D show damping inlays of embodiments of the invention with different damping materials.

The turbine blade 10 may be solid or may additionally comprise other features such as cooling means 20, 22 (see FIGS. 2, 4 and 5). At least one cooling duct 22 may be provided, for example a film cooling hole. The cooling duct 22 may be upstream of the damping inlay, providing the additional advantage of providing a flow of cooling air over the inlay. The cooling means may be provided by a cooling channel in a hollow blade using a cooling fluid, for example air. Further explanation of embodiments with a hollow blade is provided below with reference to FIG. 5.

The damping inlay 12 may be made of any appropriate material (e.g. a nickel based superalloy) and any appropriate shape to fit within the recess in the blade, such as a substantially cuboid shape with a curvature on the outer face to follow the curvature of the blade. The chamber 14 may be any appropriate shape, for example substantially cuboidal (e.g. FIG. 1) or partially ellipsoidal (e.g. FIGS. 6A and 6B). The damping material 16 may comprise a mass damper, a mass, a wire mesh, a powder, particles, a liquid, or a combination of these elements. Further discussion of the damping material is provided below with reference to FIG. 6.

FIG. 2*b* shows an alternative embodiment similar to that shown in FIG. 2, where the damping inlay 18 comprises a chamber 14 with a damping material (not shown) as previously described. In this embodiment, the damping inlay does not in itself surround the chamber, and instead the blade provides a substantial part of the outer limiting wall of the chamber. A plate 19 is provided as part of the damping inlay to close off the opening of the recess and thereby complete the chamber. An optional cooling means 20 is again shown; the blade 10 could alternatively be of another type such as those shown in FIGS. 1, 4 and 5.

In some embodiments, it is envisioned that multiple damping inlays would be provided, allowing for reduction of a plurality of damping modes. One of the advantages of this invention is that there is no particular restriction on where to place the damping inlays on the blade. FIGS. 3 and 4 show one example of this, where two damping inlays 12 are provided. In the embodiments depicted in the figures, there is always one damping inlay for each recess. However, in some embodiments, a plurality of damping inlays may be provided in the same recess. This would have the advantage of simplifying manufacture by minimising the number of required recesses.

In one preferred embodiment, shown in FIG. 5, a hollow blade 30 has a leading edge 32, a trailing edge 34, a pressure side 36, a suction side 38 and web 40. The damping inlay 12 is provided at an intersection where the web meets the blade surface, as this is a point of greater strength and placement here minimises any problems with structural weakness around the damping inlay. In alternative embodiments, one or more webs may be provided in a variety of web structures within the blade, to support the outer surface of the blade. In addition to any cooling channels 20, cooling channels 42 may be provided within the web structure within the blade, thereby providing a cooling supply. The damping inlay may also be in a reinforced section of the surface of the blade. For example, the wall thickness of the blade may be greater at or around the area where the damping inlay is provided.

In FIG. 6, some preferred embodiments of the damping material are shown. Damping inlays 50, 60, 70 and 80 each comprise a chamber 14 and a damping material. In FIG. 6A, the damping material is mass 52, with a single spherical mass shown as an example. Other mass shapes are possible, and more than one mass may be provided in some embodiments. In FIG. 6B, the damping material is a mass damper comprising a mass 62 and a spring 64. Again, other mass shapes are possible, more than one mass may be provided, and other types of mass attachment may be used instead of a spring, such as a flexible strip, for example of metal. In FIG. 6C, a wire mesh 72 is shown. One or more wire meshes of various different shapes could be provided, including cylinders, rings or bars of wire mesh; FIG. 6C shows a bar. In FIG. 6D, a powder 82 is shown as the damping material. Particles or a liquid could be used as a damping material in a similar manner to the powder. Although FIG. 6 shows a partially filled chamber, it could also be completely filled with, for example, a powder or a wire mesh, in which case deformation of the chamber due to blade movement provides damping due to friction.

The damping material may be sand, balls, water or another appropriate material. In one example, the damping material is a ceramic material such as aluminium oxide ($Al_2O_3$) particles. In examples where the damping inlay is produced by additive manufacturing (e.g. selective laser melting), the damping material (preferably a powder in this case) may be made of the same material as the material used to make the rest of the damping inlay. The damping inlay and the damping material may therefore be made in the same manufacturing step. The damping inlay may additionally comprise a heat protective layer, and the heat protective layer may also extend over at least part of the blade.

For any given damping inlay in any of the above described embodiments, the inlay may be disposed within the blade in a variety of ways. That is, the damping inlay may simply be within the outer surface of the blade, such as in FIGS. 1, 2 and 5, or it may penetrate to the edge of a structure within the blade such as damping inlay 12 in FIG. 4, with the damping inlay extending to the depth of a hollow cavity such as cooling means 20 within the blade. A further option is shown with damping inlay 13 in FIG. 4, where the damping inlay penetrates from the surface all the way through the blade. In terms of position on the surface of the blade, the damping inlay may be disposed in the side wall of the blade, particularly when in a hollow blade. Alternatively, the damping inlay may be disposed at any other appropriate point around the blade, for example in the leading edge, the suction side, the pressure side or the trailing edge. The flexibility of the invention allows considerable variation in the placement of the damping inlay.

A further embodiment of the invention describes the method of manufacture of a turbine blade with a damping inlay as described above. The method comprises the steps of manufacturing a turbine blade 10, the turbine blade having a surface and a recess in the surface and providing one or more damping inlays 12 within one or more recesses such that the damping inlay substantially maintains the aerodynamic profile of the blade, the damping inlay comprising a chamber 14 and a damping material 16 disposed within the chamber. In the design process prior to manufacturing, the location or locations at which a damping inlay or inlays would be most effective to reduce vibration stresses may also be identified.

The turbine blade 10 may be manufactured complete, after which a portion of a surface of the turbine blade is removed to create a recess in the surface. This technique can also be used to retrofit an existing blade. The portion of the surface of the turbine blade may be removed by any one of a number of processes, including eroding, grinding or milling. Alternatively, the turbine blade may be manufactured by directly creating a blade with a recess in the surface. In both case, the turbine blade may be manufactured by any appropriate means, for example a primary shaping process such as casting or forging.

The damping inlay may be manufactured independently of the turbine blade and then attached within the recess in the surface. Alternatively, the damping inlay may be manufactured by filling the recess with a damping material such as particles, and then closing the hollow structure afterwards, thereby creating a chamber within the recess. In this case, the chamber could be delineated by the sides of the recess and by a plate as shown in FIG. 2*b*. The damping inlay may also be manufactured before the blade, inserted into a cast mould and then formed into the blade during the casting process for the blade.

The damping inlay may be attached by welding, brazing, soldering, an additive manufacturing method (e.g. selective laser melting (SLM)), glue or another adhesive means. The damping inlay may be manufactured, either completely or in part, by forging, casting, welding or an additive manufacturing method (e.g. selective laser melting).

Various modifications to the embodiments described are possible and will occur to those skilled in the art without departing from the invention which is defined by the following claims.

| REFERENCE SIGNS | |
|---|---|
| 10 | turbine blade |
| 11 | surface |
| 12 | damping inlay |
| 13 | damping inlay |
| 14 | chamber |
| 16 | damping material |
| 18 | damping inlay |
| 19 | plate |
| 20 | cooling means |
| 22 | cooling duct |
| 30 | hollow blade |
| 32 | leading edge |
| 34 | trailing edge |
| 36 | pressure side |
| 38 | suction side |
| 40 | web |
| 50 | damping inlay |
| 52 | mass |

-continued

| REFERENCE SIGNS | |
|---|---|
| 60 | damping inlay |
| 62 | mass |
| 64 | spring |
| 70 | damping inlay |
| 72 | wire mesh |
| 80 | damping inlay |
| 82 | powder |

The invention claimed is:

1. A turbine blade comprising:

a side wall with an outer surface;

a recess within the outer surface;

a damping inlay within the recess, wherein the damping inlay comprises a chamber and a damping material disposed within the chamber, and the damping inlay substantially maintains the aerodynamic profile of the blade and is disposed in the side wall of the turbine blade; and a cooling means, wherein at least part of the cooling means is provided upstream of the damping inlay and includes at least one film cooling hole in the side wall of the turbine blade.

2. The turbine blade according to claim 1, wherein the damping material comprises one or more of a mass damper, a mass, a wire mesh, a powder, particles, or a liquid.

3. The turbine blade according to claim 1, wherein a plurality of damping inlays are provided for reduction of a plurality of damping modes.

4. A gas turbine comprising at least one turbine blade according to claim 1.

5. The turbine blade according to claim 1, wherein the damping inlay is made of a nickel based super alloy.

6. The turbine blade according to claim 1, wherein the damping inlay is a substantially cuboid shape with a curvature on an outer face to follow a curvature of the blade.

7. The turbine blade according to claim 1, wherein the blade is a hollow blade having a leading edge, a trailing edge, a pressure side, a suction side and a web, and wherein the damping inlay is provided at an intersection where the web meets the side wall.

8. The turbine blade according to claim 1, wherein the damping material is a spherical mass.

9. The turbine blade according to claim 1, wherein the damping material is a mass damper comprising a mass and a spring.

10. The turbine blade according to claim 1, wherein the damping inlay is disposed in the side wall of a hollow turbine blade.

11. A method of making a turbine blade comprising:

manufacturing a turbine blade, the turbine blade having a side wall with an outer surface and a recess within the outer surface; and providing a damping inlay within the recess such that the damping inlay substantially maintains the aerodynamic profile of the blade, the damping inlay comprising a chamber and a damping material disposed within the chamber and being disposed in the side wall of the turbine blade, and a cooling means, wherein at least part of the cooling means is provided upstream of the damping inlay and includes at least one film cooling hole in the side wall of the turbine blade.

12. The method of claim 11, wherein the manufacturing of the turbine blade comprises the manufacturing of the turbine blade and removing a portion of the outer surface of the turbine blade to create the recess in the outer surface.

13. The method of claim 12, wherein the portion of the outer surface of the turbine blade is removed using eroding, grinding or milling.

14. The method of claim 11, wherein the providing of the damping inlay comprises:

manufacturing the damping inlay and attaching the damping inlay within the recess.

15. The method of claim 11, wherein the providing of the damping inlay comprises:

at least partially filling the recess with a damping material and covering the recess to complete the damping inlay.

16. The method of claim 11, wherein the damping inlay is attached to the turbine blade using welding, brazing, soldering, selective laser melting, or glue.

17. The method of claim 11, wherein the damping inlay is manufactured, at least in part, by laser melting, welding, forging or casting.

18. A method of making a turbine blade comprising:

manufacturing a turbine blade, the turbine blade having a surface and a recess in the surface; and providing a damping inlay within the recess such that the damping inlay substantially maintains the aerodynamic profile of the blade, the damping inlay comprising a chamber and a damping material disposed within the chamber, wherein the turbine blade is manufactured by casting, and the damping inlay is attached to the turbine blade during casting of the turbine blade.

* * * * *